US005952142A

United States Patent [19]

Derks et al.

[11] Patent Number: 5,952,142

[45] Date of Patent: Sep. 14, 1999

[54] AZINE-CONTAINING PHOTOCONDUCTIVE ELEMENT

[75] Inventors: Petrus Johannes Maria Derks, HG Velden; Achilles Wilhelmus Maria Persoon, CR Maasbree; Maria Petronella Henrica van Horck, CN Venlo, all of Netherlands

[73] Assignee: Oce-Technologies, B.V., Venlo, Netherlands

[21] Appl. No.: 09/127,044

[22] Filed: Jul. 31, 1998

[30] Foreign Application Priority Data

Jul. 31, 1997 [NL] Netherlands ..... 1006695

[51] Int. Cl.[6] ..... G03G 5/09

[52] U.S. Cl. ..... 430/83; 430/58; 430/59

[58] Field of Search ..... 430/59, 83

[56] References Cited

U.S. PATENT DOCUMENTS

| | | | |
|---|---|---|---|
| 3,713,820 | 1/1973 | Champ et al. | 430/59 |
| 3,725,058 | 4/1973 | Hayashi et al. | 430/59 |
| 3,824,099 | 7/1974 | Champ et al. | 430/59 |
| 3,837,851 | 9/1974 | Shattuck et al. | 430/59 |
| 3,839,034 | 10/1974 | Wiedemann | 430/59 |
| 3,898,084 | 8/1975 | Champ et al. | 430/31 |
| 4,123,270 | 10/1978 | Heil et al. | 430/128 |
| 4,286,040 | 8/1981 | van Lomm | 430/127 |
| 4,420,548 | 12/1983 | Sakai et al. | 430/59 |
| 4,777,296 | 10/1988 | Sasaki | 430/72 |
| 4,784,929 | 11/1988 | Ueda | 430/83 |

FOREIGN PATENT DOCUMENTS 1172355 11/1969 United Kingdom .

*Primary Examiner*—Roland Martin

*Attorney, Agent, or Firm*—Birch, Stewart, Kolasch & Birch, L.L.P.

[57] ABSTRACT

A photoconductive element containing a transport substance and an azine, wherein the azine is a transport substance having the molecular formula:

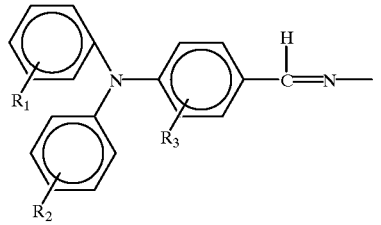

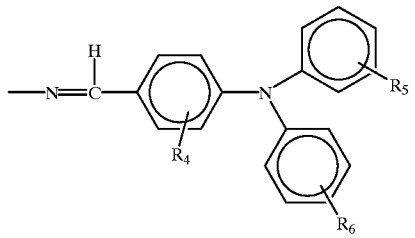

wherein $R_1$–$R_6$ can be different or the same constituents, and are hydrogen or $C_1$–$C_4$ alkyl groups. The transport substance is preferably a tri-aryl amine or a substituted stilbene compound. These photoconductive elements reduce the deterioration of the photoelectrical properties.

7 Claims, No Drawings

AZINE-CONTAINING PHOTOCONDUCTIVE ELEMENT

The present invention relates to a photoconductive element containing a transport substance and an azine. Photoconductive elements of this kind are known, for example, from JP-61043753. The azine compound is present in order to counteract any gradual deterioration of photoelectric properties (optical fatigue) during use. However, the azines mentioned in this Japanese Patent Application have the disadvantage that the photoelectric properties of the photoconductive element in the products are drastically impaired. This deterioration in photoelectric properties increases with an increasing quantity of azine.

The object of the invention is to provide a photoconductive element which when used exhibits a reduction in the deterioration of the photoelectric properties, while the other properties thereof are retained.

To this end, according to the invention, the azine selected is a compound having the molecular formula:

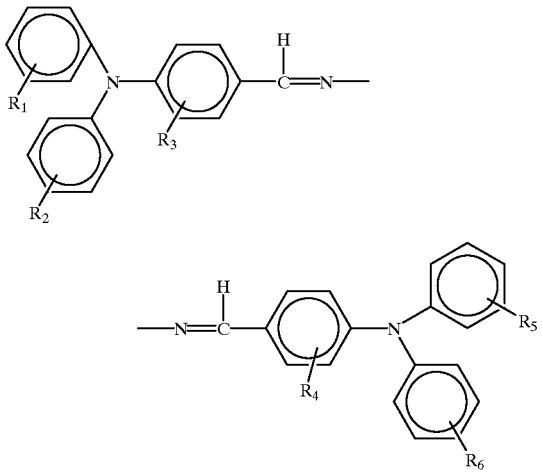

wherein $R_1$–$R_6$ can be different or the same constituents, selected from the group consisting of hydrogen and $C_1$–$C_4$ alkyl groups.

A particular advantage of these transport layers with a transport substance and azine is that the crystallization sensitivity, i.e., the tendency for crystallization of the transport substance in the transport layer binder, is drastically reduced.

More particularly, the transport substance in the photoconductive elements is selected from the group consisting of tri-aryl amines and substituted stilbenes, such as compounds in accordance with the following general formula:

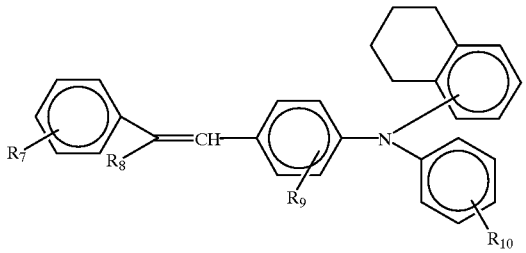

where $R_7$, $R_9$ and $R_{010}$ may be different or the same substituents, selected from $C_1$–$C_4$ alkyl groups, and $R_8$ may be a hydrogen atom, a $C_1$–$C_4$ alkyl group, an aryl group, an aryl group or an alkyl substituted aryl group. The photoconductive elements selected are preferably those having as stilbene a compound in which $R_7$, $R_9$ and $R_{10}$ represents a hydrogen atom and $R_{10}$ a hydrogen atom or a methyl group.

In another embodiment, a tri-aryl amine having the following molecular formula is used:

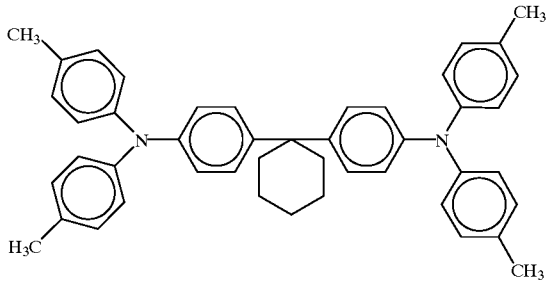

Single-layer or multi-layer photoconductive elements can be used in the invention. In a single-layer photoconductive element, a charge-generating pigment, a transport substance and azine are applied in one layer to a conductive substrate. In practice it has been found favorable to apply the charge-generating compounds and the transport substances in different layers to a conductive substrate. Multi-layer photoconductive elements of this kind are referred to, for example, in U.S. Pat. Nos. 3,713,820; 3,725,058; 3,824,099; 3,837,851; 3,839,034; and 3,898,084.

The radiation-sensitive compound or compounds in the charge-generating layer may be of an organic or inorganic type. Where an inorganic material is used, it is generally present in the form of finely divided particles in a binder or in the form of a homogeneous film obtained, for example, by vapor coating. Selenium is a frequently used inorganic material. If an organic material is used it may, for example, be present in the form of a film-forming organic polymer, such as, for example, polyvinyl carbazole or polyvinyl pyrene or in the form of finely divided pigment particles dispersed in a binder such as, for example, Phenelac Blue and derivatives of this compound. However, pigment binder layers of this kind have a number of disadvantages in respect of uniformity and controllability of the photoelectric properties. Methods are therefore proposed in which the radiation-sensitive charge-generating pigments are applied in molecular divided form. The advantage of this technique is that the charge-generating layers can be thinner and smoother than the pigment binder layers. Charge-generating layers which contain radiation-sensitive compounds in molecular divided form are, for example, referred to in U.S. Pat. Nos. 4,123,270 and 4,286,040, and GB-A-1 172 355.

At the present time, use is made of organic photoconductive pigments such as perylene pigments, bisazo pigments, quinone pigments and phthalocyanine pigments. Pigments of this kind can easily be vaporized and then applied to a suitable substrate in order to obtain extremely thin homogeneous charge-generating layers. A charge transport layer is then applied to these layers and possibly a hard protective top layer.

Preferably, use is made of a vapor-coated layer of perylene compounds of the following molecular formulae:

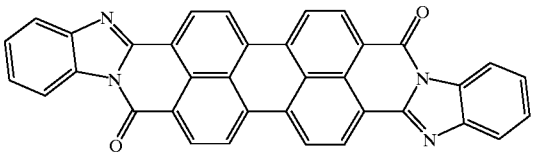

or

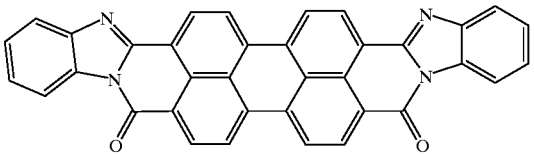

or a vapor-coated layer of a mixture of these compounds.

The charge transport layer must permit transport for charge carriers such as, for example, holes.

The transport substances can be dissolved in a suitable binder for the purpose, such as polycarbonate (for example Lexan™, ICI and polyester carbonates). The substrate may contain an organic layer such as Mylar (du Pont™) or Melinex (ICI™) or another substrate suitable for the purpose, a semi-conductive layer or a conductive layer such as aluminum, chromium, nickel, etc. If necessary, the polymeric substrate can be made conductive by the application of one or more thin metal layers such as aluminum, chromium, nickel, etc. The substrate may be a metal roller or a flexible endless strip of paper or plastic.

The invention will now be explained hereinafter with reference to the following examples:

TABLE

| Ex. | | Start Vrest (V) | DO (%) | Vrest Start | After light Exposure |
|---|---|---|---|---|---|
| 1 | TTA | 48 | 13 | 275 | After 1 hour TL light |
| 2 | TTA:Azine 1 = 95:5 | 44 | 11 | 60 | After 1 hour TL light |
| 3 | TTA:Azine 1 = 75:25 | 35 | 8 | 46 | After 1 hour TL light |
| 4 | TTA:Azine 2 = 95:25 | 142 | 13 | — | |
| 5 | TTA:Azine 2 = 75:25 | 444 | 27 | — | |

TABLE-continued

| Ex. | | Start Vrest (V) | DO (%) | Vrest Start | After light Exposure |
|---|---|---|---|---|---|
| 6 | TTA:Azine 3 = 95:25 | 70 | 12 | — | |
| 7 | TTA:Azine 3 = 75:25 | 197 | 16 | — | |
| 8 | Stilbene-1 | 27 | 9 | 107 | After 100 hours CAT light |
| 9 | Stilbene-2 | 26 | 8 | 149 | After 100 hours CAT light |
| 10 | Stilbene-1:Azine-1 = 34:2 | 27 | 12 | 21 | After 44 hours CAT light |
| 11 | Stilbene-2:Azine-1 = 34:2 | 28 | 10 | 28 | After 60 hours CAT light |
| 12* | TAPC | 0.7 | 2 | 8.1 | After 1 hour TL light |
| 13* | TAPC:Azine 1 = 35:5 | 0.8 | 2 | 0.5 | After 1 hour TL light |

—Not determined.

*OPC with a 10$\mu$ transporting layer charged to −150 V usable with mono-component toner.

Vrest is the ASV (apparatus surface voltage) remaining after exposure of a photoconductive element charged to −800 V, to 15 mJ/m$^2$ white light DO (%) is the dark discharge in the first 2 seconds after charging.

The Table gives a number of examples of photoconductive elements. Example 1 is a photoconductive element having a perylene generating layer above which is a transport layer which contains tritolylamine (TTA).

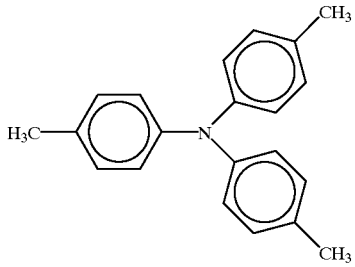

This photoconductive TTA element initially has a reasonably high Vrest, which is greatly increased after just 1 hour exposure to ambient light (TL light). With the admixture of azine 1 in accordance with the formula

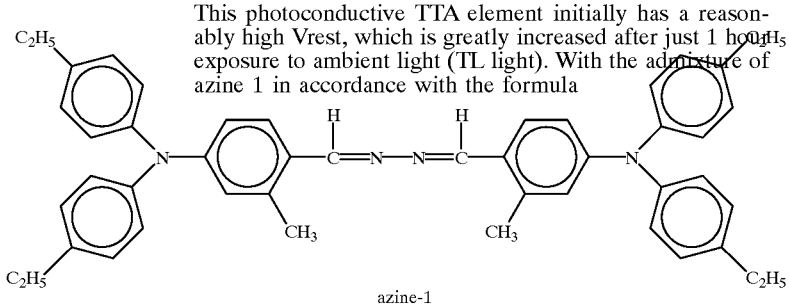

azine-1 the initial Vrest is lowered somewhat, while after 1 hour exposure to ambient light the Vrest light is increased. This value is hardly increased even after exposure to light in a copier or printer.

Accordingly, the photoconductive elements according to the invention have the advantage that the properties remain substantially constant after long periods of use and it is much easier to handle the material outside the copier or printer in ambient light. Azines according to the above-mentioned Japanese Patent Application are unsuitable. In Examples 4 and 5, TTA and an azine-2 in accordance with the molecular formula

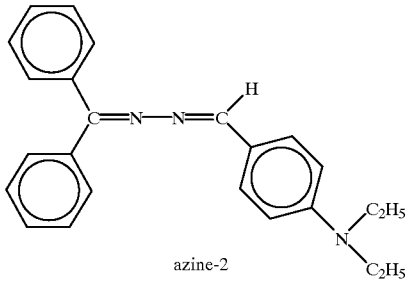

azine-2 and in Examples 6 and 7 TTA and another azine-3 in accordance with the molecular formula:

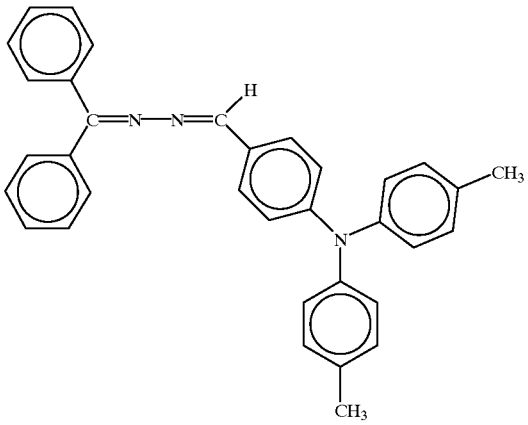

azine-3 were added in various ratios. At the very start these photoconductive elements already had an unacceptably high Vrest.

Photoconductive elements according to Examples 8 and 9 contain a vapor-coated perylene layer as generating layer and a transport layer containing a stilbene. Stilbene-1 has the molecular formula:

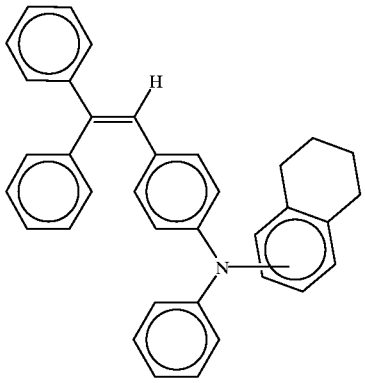

Stilbene-1 and stilbene-2 has a the molecular formula:

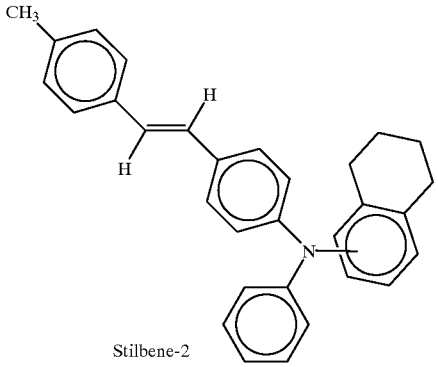

Stilbene-2

These photoconductive elements exhibit a considerable Vrest deterioration after exposure to CAT light. This deterioration was completely eliminated after adding a small quantity of azine-1 to these stilbenes. These photoconductive elements do not exhibit any deterioration even after exposure to the ambient light.

Examples 12 and 13 contain an evaporated perlene layer as a generation layer and a thin transporting layer containing a tri-aryl amine, TAPC, TAPC has the general formula:

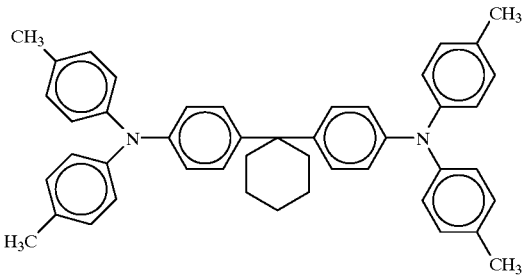

The photoconductor of example 12 also shows a large increase in the Vrest value after exposure to TL light. When azine-1 is added in a small amount, this increase is clearly eliminated (Example 13).

The quantity of azine can be varied within wide limits (from about 2% by weight to 50% by weight). The stilbenes can also be mixtures of cis and transisomers around the olefinic fragment:

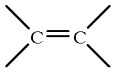

The tetrahydronaphthyl group can be fixed to the nitrogen atom of the tertiary amino group at various places.

We claim:

1. A photoconductive element containing a transport substance and an azine, wherein the azine is a transport substance having the molecular formula:

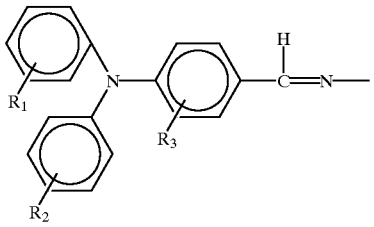

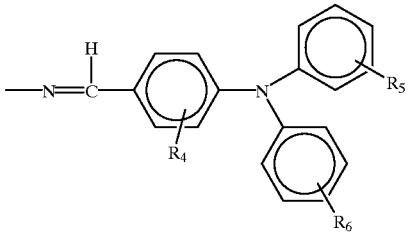

wherein $R_1$–$R_6$ can be different or the same constituents and are selected from the group consisting of hydrogen and $C_1$–$C_4$ alkyl groups.

2. A photoconductive element according to claim 1, wherein the transport substance is selected from the group consisting of triaryl amines and substituted stilbenes.

3. A photoconductive element according to claim 2, wherein the substituted stilbene compound is a compound having the molecular formula:

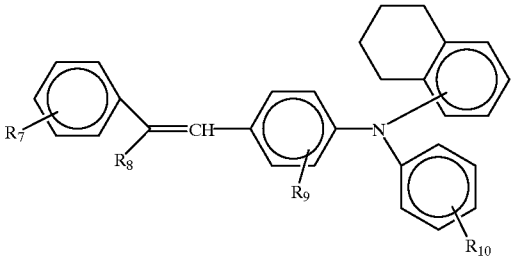

where $R_7$, $R_9$ and $R_{10}$ may be different or the same substituents and are selected from the group consisting of hydrogen and $C_1$–$C_4$ alkyl groups and $R_8$ can be a substituent selected from the group consisting of hydrogen $C_1$–$C_4$ alkyl groups, an aryl group and alkyl substituted aryl groups.

4. A photoconductive element according to claim 3, wherein $R_7$ and $R_9$ are hydrogen and $R_{10}$ is a methyl group.

5. A photoconductive element according to claim 3, wherein $R_7$, $R_9$ and $R_{10}$ are hydrogen and $R_8$ is a phenyl group.

6. A photoconductive element according to claim 2, wherein the tri-aryl amine is tritolyl amine.

7. A photoconductive element according to claim 2, wherein the tri-aryl amine is a compound having the molecular formula:

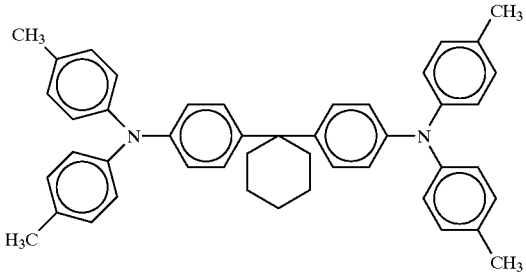

* * * * *